US010781769B2

(12) United States Patent
Choudhary et al.

(10) Patent No.: US 10,781,769 B2
(45) Date of Patent: Sep. 22, 2020

(54) METHOD OF MANUFACTURING AN ENGINE BLOCK

(71) Applicant: GM Global Technology Operations LLC, Detroit, MI (US)

(72) Inventors: Lokesh Choudhary, Bengaluru (IN); Su Jung Han, West Bloomfield, MI (US); Martin S. Kramer, Davisburg, MI (US); Brian W. Geiser, Ortonville, MI (US); Brian Christopher Leuenhagen, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/214,739

(22) Filed: Dec. 10, 2018

(65) Prior Publication Data

US 2020/0182188 A1 Jun. 11, 2020

(51) Int. Cl.

| | |
|---|---|
| ***F02F 1/04*** | (2006.01) |
| ***F02F 1/10*** | (2006.01) |
| ***B22D 19/00*** | (2006.01) |
| ***F02F 7/00*** | (2006.01) |
| ***B22D 15/02*** | (2006.01) |
| ***F02F 1/00*** | (2006.01) |
| *F02B 75/18* | (2006.01) |

(52) U.S. Cl.

CPC ..... *F02F 1/108* (2013.01); *B22D 15/02* (2013.01); *B22D 19/0009* (2013.01); *F02F 1/004* (2013.01); *F02F 7/0007* (2013.01); *F02F 7/0085* (2013.01); *F02B 2075/1816* (2013.01); *F02F 2200/06* (2013.01)

(58) Field of Classification Search

CPC ..... F02F 1/108; F02F 7/0085; F02F 1/004; F02F 7/0007; F02F 2200/06; F02F 1/18; F02F 1/16; F02F 1/00; B22D 19/0009; B22D 15/02; F02B 2075/1816; F01P 2003/021

See application file for complete search history.

(56) References Cited

U.S. PATENT DOCUMENTS

| | | | | |
|---|---|---|---|---|
| 3,884,658 A * | 5/1975 | Roach | B01D 45/12 | 55/315 |
| 4,903,652 A * | 2/1990 | Field | F02F 1/108 | 123/193.2 |
| 5,000,244 A * | 3/1991 | Osborne | B22C 9/046 | 164/34 |
| 5,080,056 A * | 1/1992 | Kramer | F02F 7/0007 | 123/193.4 |
| 5,114,468 A * | 5/1992 | Akutsu | C22C 1/0425 | 75/234 |

(Continued)

*Primary Examiner* — Long T Tran

(57) ABSTRACT

A cylinder block for use in an internal combustion engine includes a first and second cylinder bores, a first and second cylinder bore liners, and a Siamese insert. The first and second cylinder bores are disposed adjacent to each other. The first and second cylinder bores each comprise a first cylinder bore wall and a second cylinder bore wall, respectively, and a shared cylinder bore wall. The first cylinder bore liner is disposed on a first inner surface of the first cylinder bore wall and the second cylinder bore liner is disposed on a second inner surface of the second cylinder bore wall. The Siamese insert is disposed in a top portion of the shared cylinder bore wall.

17 Claims, 5 Drawing Sheets

(56) References Cited

U.S. PATENT DOCUMENTS 6,138,619 A * 10/2000 Etemad ..... F01P 3/02 123/41.74
6,205,959 B1 * 3/2001 Smetan ..... F02F 7/0007 123/41.72
6,298,899 B1 * 10/2001 Baltz ..... B22C 9/103 164/28
6,349,681 B1 * 2/2002 Li ..... F02F 7/0007 123/41.74
7,513,237 B1 * 4/2009 Liebert ..... F02F 1/102 123/195 H
8,435,361 B2 * 5/2013 Gaag ..... C22C 9/04 123/188.3
9,388,763 B2 * 7/2016 Achenbach ..... F02F 1/004
2005/0173091 A1 * 8/2005 Cantu-Gonzalez ..... B22D 19/0009 164/98
2005/0235930 A1 * 10/2005 Xin ..... F02F 1/108 123/41.74
2005/0235931 A1 * 10/2005 Zahdeh ..... F02F 1/108 123/41.74
2006/0124082 A1 * 6/2006 Grunenberg ..... F02F 1/108 123/41.74
2007/0012179 A1 * 1/2007 Takami ..... F02F 1/12 92/171.1
2007/0227475 A1 * 10/2007 Hiramitsu ..... F02F 1/16 123/41.72
2010/0024748 A1 * 2/2010 Chae ..... F01P 3/02 123/41.72
2014/0331947 A1 * 11/2014 Beyer ..... F01P 3/02 123/41.74
2015/0285125 A1 * 10/2015 Hayman ..... F01P 3/02 123/41.72
2016/0040621 A1 * 2/2016 Beyer ..... B22D 19/0072 123/193.1
2017/0159601 A1 * 6/2017 Park ..... F02F 1/14
2017/0167435 A1 * 6/2017 Wang ..... B22C 9/02
2019/0003415 A1 * 1/2019 Becker ..... F02F 1/16

* cited by examiner 62 60

| Composition, Weight % | Form | Temper | Testing Temperature | | Event | Stress for Event to Occur in Time Indicated | | | | | |
|---|---|---|---|---|---|---|---|---|---|---|---|
| | | | | | | 100h | | 500h | | 1,000h | |
| | | | °C | °F | | N/mm² | $10^3$ psi | N/mm² | $10^3$ psi | N/mm² | $10^3$ psi |
| 9.62Al 3.93Fe 0.62Ni 3.36Mn 0.46Zn Rem Cu | (16) Rod | Annealed | 200 | 392 | Rupture | 427 | 62 | 402 | 58 | 387 | 56 |
| | | | 200 | 392 | 2.0% Strain | 353 | 51 | 330 | 48 | 319 | 46 |
| | | | 200 | 392 | 1.0% Strain | 284 | 41 | 260 | 38 | 250 | 36 |
| | | 1/2 at 850°C | 200 | 392 | 0.5% Strain | 226 | 33 | 216 | 31 | 211 | 30 |
| | | | 200 | 392 | 0.2% Strain | 191 | 28 | 183 | 27 | 177 | 26 |
| | | | 200 | 392 | 0.1% Strain | 178 | 26 | 170 | 25 | 167 | 24 |
| | | | 200 | 392 | 0.05% Strain | 167 | 24 | 159 | 23 | 154 | 22 |
| CuAllOFe Specification only | | Annealed 1/2 at 850°C | 300 | 572 | Rupture | | | 206 | 30 | | |
| | | | 300 | 572 | 0.2% Strain | | | | | 59 | 8.6 |
| | | | 300 | 572 | 0.1% Strain | | | | | 49 | 7.1 |

* Comp. conforms to CA105

FIG. 5

METHOD OF MANUFACTURING AN ENGINE BLOCK

The present disclosure relates generally to the manufacture of Aluminum alloy engine block and more specifically to methods of manufacturing cast engine blocks having improved robustness while maintaining weight advantages over other alloys and processes.

The use of lightweight Aluminum alloys in cylinder blocks for internal combustion engines has greatly enhanced the vehicle energy efficiency by reducing the overall weight of the vehicle at the same time maintaining most of the capability of the cylinder block. Additional design adaptations to lighter and more compact engine systems have caused some challenges to continuing use of Aluminum alloys as the material of choice for some engine applications. For example, elevated heat stress in certain areas of the cylinder block have cause premature failures due to the geometry of the cylinder block and the inability to properly cool these areas.

Accordingly, there is a need in the art for an improved cylinder block design and method for manufacturing the new cylinder block that extends the useful life of the cylinder block in service, prevents catastrophic failure, and provides the design necessary to maintain and improve upon the use of lightweight Aluminum alloys for achieving fuel economy standards.

SUMMARY

The present disclosure comprises a cylinder block for use in an internal combustion engine. The cylinder block includes a first and second cylinder bores, a first and second cylinder bore liners, and a Siamese insert. The first and second cylinder bores are disposed adjacent to each other. The first and second cylinder bores each comprise a first cylinder bore wall and a second cylinder bore wall, respectively, and a shared cylinder bore wall. The first cylinder bore liner is disposed on a first inner surface of the first cylinder bore wall and the second cylinder bore liner is disposed on a second inner surface of the second cylinder bore wall. The Siamese insert is disposed in a top portion of the shared cylinder bore wall.

In one example of the present disclosure, the Siamese insert comprises a high temperature creep resistant alloy and the cylinder block comprises an Aluminum Alloy.

In another example of the present disclosure, the Siamese insert comprises an Aluminum-Bronze alloy having between about 8 to 10 wt. % Aluminum, Iron, Nickle, Manganese, Zinc, and Copper.

In yet another example of the present disclosure, the Siamese insert comprises an Aluminum-Bronze alloy having about 9.62 wt % Aluminum, 3.93 wt % Iron, 0.62 wt % Nickle, 3.36 wt % Manganese, 0.46 wt % Zinc, and the balance Copper.

In yet another example of the present disclosure, the Siamese insert comprises one of an Aluminum alloy, a steel alloy, a bronze alloy, and a ceramic-metal material.

In yet another example of the present disclosure, the Siamese insert comprises a top surface that includes a portion of a head deck sealing surface.

In yet another example of the present disclosure, the Siamese insert comprises a first and second bore liner pocket, the first bore liner is partially dispose in the first bore liner pocket, and the second bore liner is partially disposed in the second bore liner pocket.

In yet another example of the present disclosure, the shared cylinder bore wall comprises a first portion of the first cylinder bore liner, a second portion of the second cylinder bore liner, a third portion of the first cylinder bore wall, a fourth portion of the second cylinder bore wall, and the Siamese insert.

The present disclosure further comprises a cylinder block for use in an internal combustion engine. The cylinder block includes a first and second cylinder bores, a first and second cylinder bore liners, and a Siamese insert. The first cylinder bore liner is disposed on a first inner surface of the first cylinder bore wall and the second cylinder bore liner is disposed on a second inner surface of the second cylinder bore wall. The Siamese insert comprises a top surface and a high temperature creep resistant alloy. The Siamese insert is disposed in a top portion of the shared cylinder bore wall and the top surface includes a portion of a head deck sealing surface.

In one example of the present disclosure, the Siamese insert comprises an Aluminum-Bronze alloy having between about 8 to 10 wt. % Aluminum, Iron, Nickle, Manganese, Zinc, and Copper.

In another example of the present disclosure, the Siamese insert comprises an Aluminum-Bronze alloy having about 9.62 wt % Aluminum, 3.93 wt % Iron, 0.62 wt % Nickle, 3.36 wt % Manganese, 0.46 wt % Zinc, and the balance Copper.

In yet another example of the present disclosure, the Siamese insert comprises one of an Aluminum alloy, a steel alloy, a bronze alloy, and a ceramic-metal material.

In yet another example of the present disclosure, the Siamese insert comprises a first and second bore liner pocket, the first bore liner is partially dispose in the first bore liner pocket, and the second bore liner is partially disposed in the second bore liner pocket.

In yet another example of the present disclosure, the shared cylinder bore wall comprises a first portion of the first cylinder bore liner, a second portion of the second cylinder bore liner, a third portion of the first cylinder bore wall, a fourth portion of the second cylinder bore wall, and the Siamese insert.

The present disclosure further comprises a method for manufacturing a cylinder block for an internal combustion engine. The method includes forming a sand core package and mold comprising a cylinder bore liner for each cylinder of the engine. The method further includes casting the cylinder block by pouring a liquid metal alloy into the mold, and cleaning and machining the cylinder block after cooling.

In one example of the present disclosure, forming the sand core package and mold comprising the cylinder bore liner for each cylinder of the engine further comprises forming the sand core package and mold comprising the cylinder bore liner for each cylinder of the engine and a Siamese insert disposed between each cylinder bore liner.

In another example of the present disclosure, casting the cylinder block by pouring the liquid metal alloy into the mold further comprises pouring a liquid Aluminum alloy into the mold to cast-in-place the cylinder bore liners and Siamese inserts.

In another example of the present disclosure, the method further includes fabricating a Siamese insert between each of the cylinder bore liners using a metal alloy additive technique.

In yet another example of the present disclosure, the method further includes fabricating a Siamese insert between each of the cylinder bore liners using at least one of laser cladding, cold/kinetic spray, and thermal spray metal adding techniques.

In yet another example of the present disclosure, the method further includes fixing a Siamese insert between each of the cylinder bore liners.

In yet another example of the present disclosure, the method further includes brazing a Siamese insert between each of the cylinder bore liners.

The above features and advantages and other features and advantages of the present disclosure are readily apparent from the following detailed description when taken in connection with the accompanying drawings.

BRIEF DESCRIPTION OF THE DRAWING

The drawings described herein are for illustration purposes only and are not intended to limit the scope of the present disclosure in any way.

FIG. 5 is a chart depicting test results for an example alloy used in the Siamese inserts according to the principles of the present disclosure.

DESCRIPTION

Figure 1:
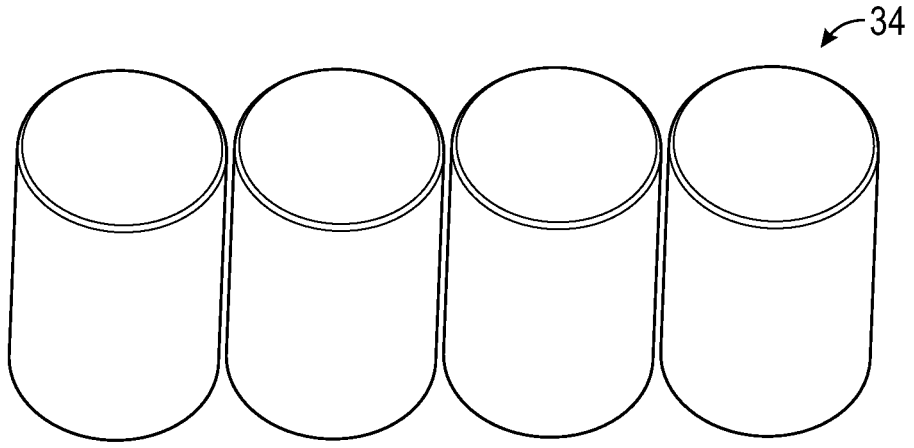
FIG. 1 is a perspective view of cylinder bore liners according to the principles of the present disclosure.
Figure 2:
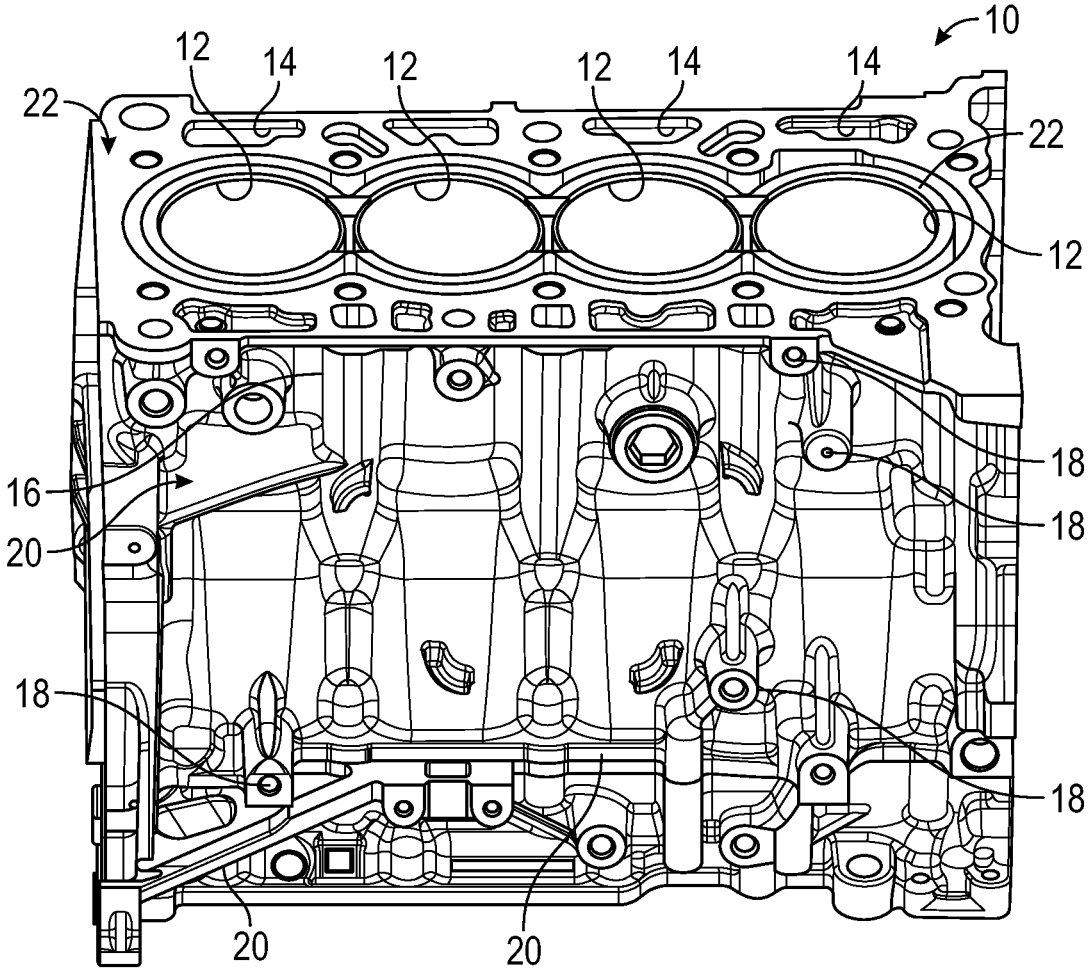
FIG. 2 is a side view of a cast engine block having cast-in-place cylinder bore liners according to the principles of the present disclosure.

Examples of the present disclosure advantageously provide method of manufacturing a cylinder block 10 for an internal combustion engine. The cylinder block 10, as depicted after various stages of the method in FIGS. 1-4, is arranged in a V8 configuration. However, other configurations of cylinder blocks 10 are considered without departing from the present disclosure. Preferably, at least two cylinder bores 12 of the cylinder block 10 are adjacent to each other and share a portion of a bore wall. Thus, inline, "V", "W" or flat configurations may all be included in this disclosure. The cylinder block 10 includes several internal and external features including but not limited to cylinder bores 12, internal water passages 14, internal oil passages 16, bolt bosses 18, structural ribs 20, and sealing surfaces 22. More particularly, the cylinder bores 12 include a bore wall 24 having a top end 26 and a bottom end (not shown). The top end 26 is flush with a head deck sealing surface 28 while the bottom end is formed to terminate in a crankcase cavity (not shown). The bore wall 24 of a first cylinder bore 30 is shared with an adjacent second cylinder bore 32. In this manner, an arrangement of cylinder bores 30, 32 having common or shared bore walls 36 are considered to have a Siamese cylinder bore arrangement. One of the major benefits of having a Siamese cylinder bore arrangement is to shorten the length and to reduce the weight of the cylinder block 10 making a more compact engine package that provides the opportunity to save weight in other components of the vehicle.

Manufacturing a cylinder block 10 as shown in FIGS. 1-4 includes casting iron or aluminum based alloys. When using aluminum based alloys, a cylinder bore liner 34 can be included to improve the wear characteristics of the surface 38 of the bore walls 24. The cylinder bore liner 34 is formed from an iron based alloy and can be cast or press fit into the aluminum cylinder block 10. Alternatively, the cylinder bore liner 34 can be sprayed onto the parent metal cylinder bore 30, 32 using a plasma metal spraying technique or other manufacturing process.

Figure 3:
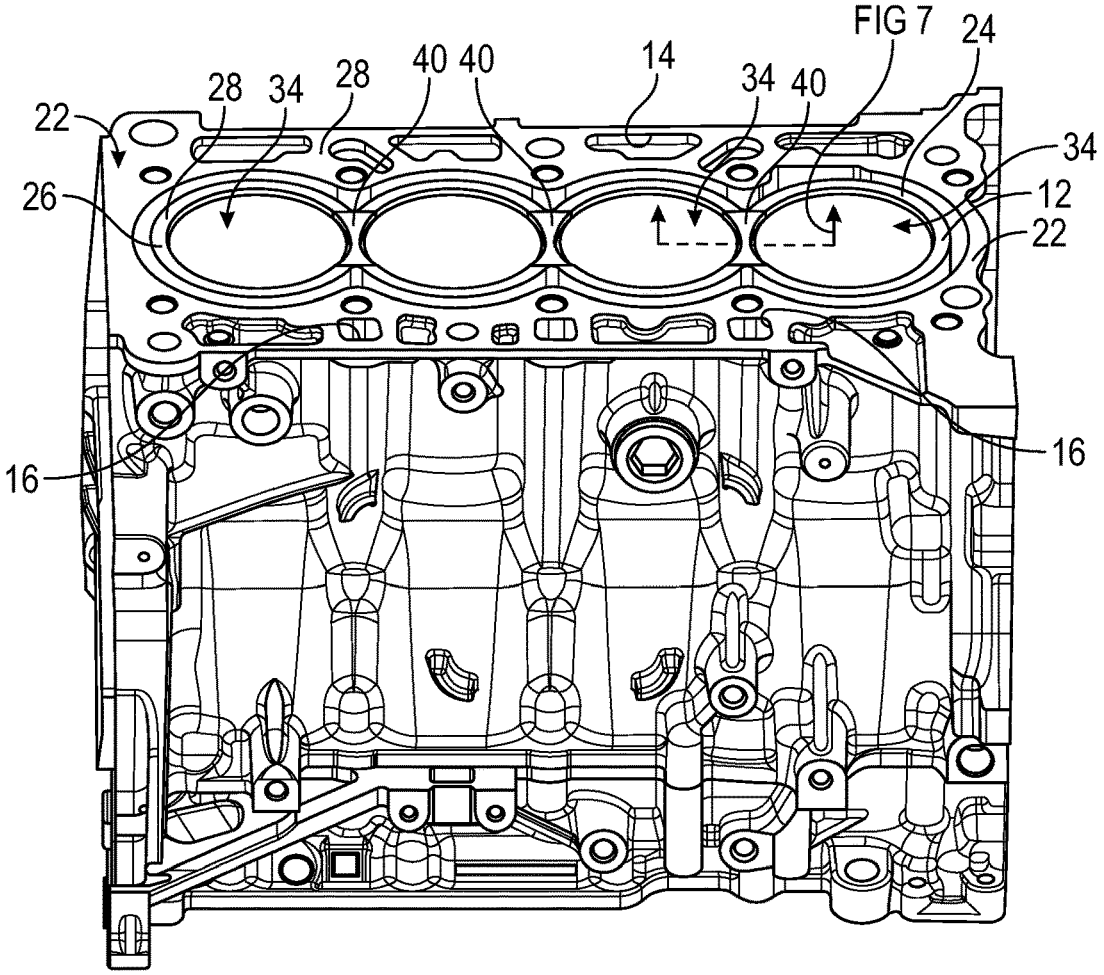
FIG. 3 is a side view of a cast engine block having cast-in-place cylinder bore liners and Siamese inserts according to the principles of the present disclosure.
Figure 4:
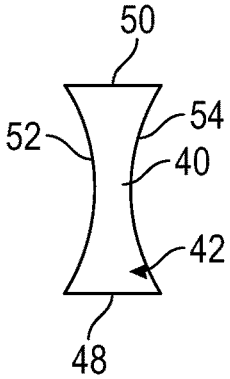
FIG. 4 is a perspective and plan view of Siamese inserts according to the principles of the present disclosure.
Figure 4:
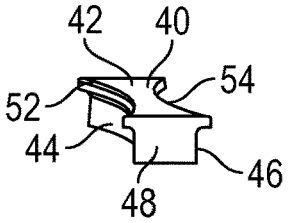
Figure 7:
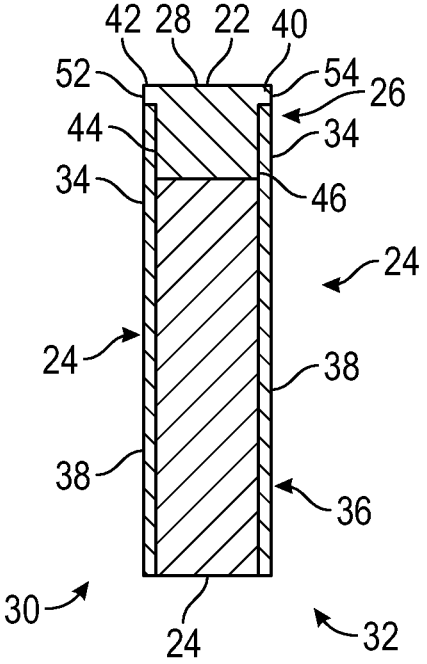
FIG. 7 is a cross section of a cylinder block according to the principles of the present disclosure.

Focusing more on FIGS. 3, 4, and 7, a cylinder block 10 including a Siamese insert 40 is illustrated. The Siamese insert 40 is disposed at the top end 26 of the shared bore wall 36. The purpose of the Siamese insert 40 is to replace the cast Aluminum alloy in this area with an alternative alloy having improved high temperature characteristics. For example, a major source of failure of cylinder blocks 10 having Siamese bore arrangements is the deterioration of the aluminum alloy of the sealing surface 22 between the cylinder bores 12 due to high thermal loading and low creep resistance of the cast aluminum alloy. The high thermal loading is higher in this portion of the cylinder bores 12 due to the lack of internal water passages 14 in this area and receiving heat from adjacent cylinder bores 30, 32. Two major failure modes result. The first failure mode is the failure of the head gasket (not shown) to seal between the cylinder bores 12 and water passages 14 due to the recession of the aluminum alloy. The head gasket failure causes high pressure communication between the adjacent cylinders 30, 32. The second failure mode is increase cylinder bore 12 distortion thus causing the piston assembly to not seal against the bore wall 24. This results in increased blow-by causing a reduction in fuel economy, increase in oil consumption, and poor emissions.

The Siamese insert 40 includes a sealing surface 42, a first bore liner pocket 44, a second bore liner pocket 46, a first interface surface 48, a second interface surface 50, a first top ridge 52, and a second top ridge 54. The Siamese insert 40, when displayed in a plan view as shown in FIG. 4, has an hourglass-like shape that conforms to the cylindrical shape of the first and second cylinder bores 30, 32. The first bore liner pocket 44 receives a bore liner 34 of the first cylinder bore 30 and the second bore liner pocket 46 receives a bore liner 34 of the second cylinder bore 32. The first and second interface surfaces 48, 50 are adjacent to and connect with the cylinder block 10 through the remaining portions of the cylinder bore walls 24. The method of connection or attachment of the Siamese inserts 40 to the cylinder block 10 maybe any one of a number of metal joining techniques. For example, the Siamese insert 40 may be brazed or soldered into place. Additionally, the Siamese insert 40 may be cast into place in the same manner that the cylinder bore liners 34 are cast into place.

Turning now to FIG. 5, an example of a Copper based alloy for use in the Siamese inserts 40 is illustrated. The chart 60 provides a composition 62 for the Copper based alloy including about 9.62 wt % Aluminum Al, 3.93 wt % Iron Fe, 0.62 wt % Nickle Ni, 3.36 wt % Manganese Mn, 0.46 wt % Zinc Zn, and the balance Copper Cu. Additionally, data from testing of this particular alloy includes strength testing after several hours at high temperatures. For example, strength tests were run on samples after 100, 500, and 1000 hours at 200° C. and 300° C.

Figure 6:
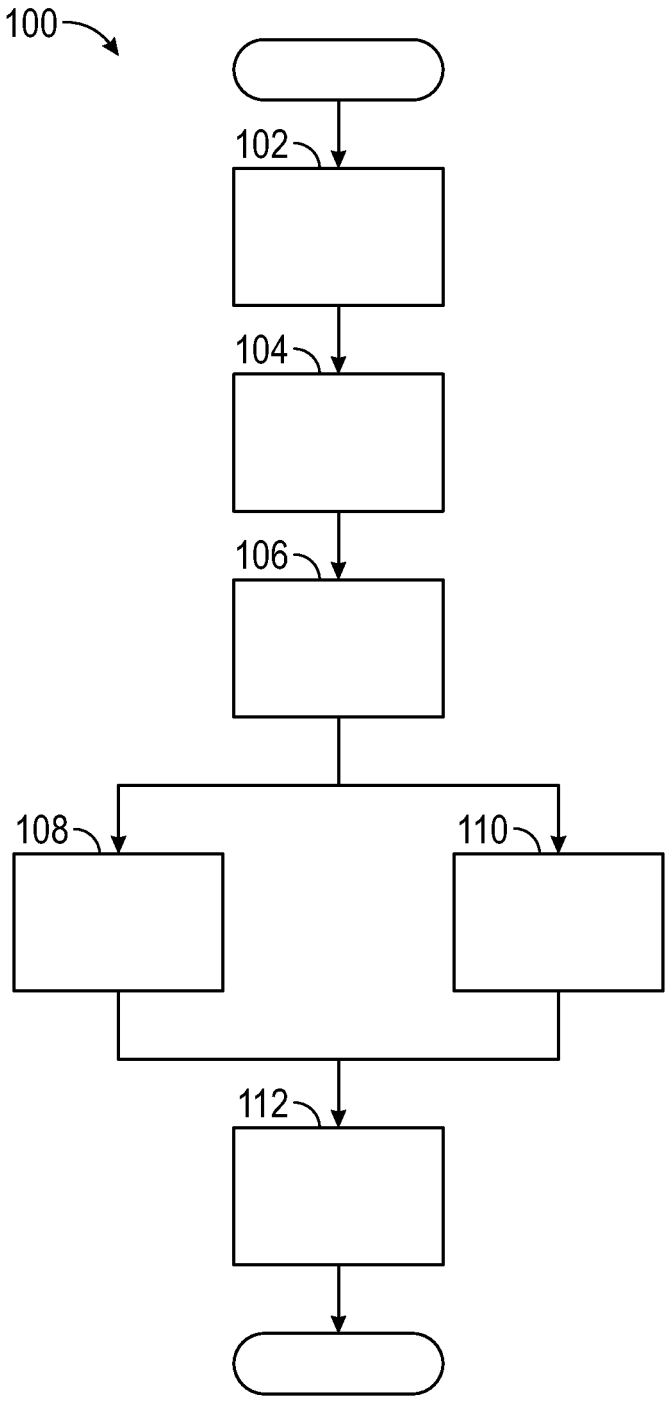
FIG. 6 is a flow chart depicting a manufacturing method for an Aluminum alloy engine block according to the principles of the present disclosure.

Referring now to FIG. 6, a method of manufacturing an aluminum cylinder block 10 is detailed and referred to as method 100. The method 100 begins with a first step 102 as a sand core and sand mold or semi-permanent mold casting process by forming or blowing sand cores including a crankcase or cylinder bore core having a cast-in-place bore liner 34 for each cylinder bore. A second step 104 includes assembling the various individual sand cores of the sand core package. During the assembly of the sand cores a number of Siamese inserts 40 may be placed into the sand core package so that the Siamese inserts 40 are cast-in-place between the cylinder bores 12. Alternatively, a third step 106 includes casting the cylinder block 10 without the Siamese inserts 40. In this regard, a fourth step 108 may be to braise or otherwise join the Siamese inserts 40 to the cylinder block 10 between the cylinder bores 12. Alternatively, a fifth step 110 includes fabricating the Siamese inserts 40 in the cylinder block 10 using an alloy adding technique such as laser cladding, cold/kinetic spray, thermal spray, and a combination of the alloy adding techniques. The alloy adding techniques include a deposition of a high creep strength alloy in place between the cylinder bores 12 forming the Siamese insert 40. Other alloy adding techniques may be considered without departing from the scope of the disclosure. A sixth step 112 of the method 100 include machining the casting thus achieving a lightweight and compact Aluminum alloy cylinder block having high creep strength alloys disposed between the cylinder bores 12 at the sealing surface 22 of the cylinder head gasket.

While examples have been described in detail, those familiar with the art to which this disclosure relates will recognize various alternative designs and examples for practicing the disclosed structure within the scope of the appended claims.

The following is claimed:

1. A cylinder block for use in an internal combustion engine, the cylinder block comprising:

a first and a second cylinder bores disposed adjacent to each other, the first and second cylinder bores each comprising a first cylinder bore wall and a second cylinder bore wall, respectively, and a shared cylinder bore wall;

a first cylinder bore liner and a second cylinder bore liner, and wherein the first cylinder bore liner is disposed on a first inner surface of the first cylinder bore wall and the second cylinder bore liner is disposed on a second inner surface of the second cylinder bore wall; and a Siamese insert disposed in a top portion of the shared cylinder bore wall, wherein the Siamese insert includes a first and second bore liner pocket, and the first bore liner is partially disposed in the first bore liner pocket and the second bore liner is partially disposed in the second bore liner pocket.

2. The cylinder block of claim 1 wherein the Siamese insert comprises a high temperature creep resistant alloy and the cylinder block comprises an Aluminum Alloy.

3. The cylinder block of claim 1 wherein the Siamese insert comprises an Aluminum-Bronze alloy having between 8 to 10 wt. % Aluminum, Iron, Nickle, Manganese, Zinc, and Copper.

4. The cylinder block of claim 1 wherein the Siamese insert comprises an Aluminum-Bronze alloy having 9.62 wt % Aluminum, 3.93 wt % Iron, 0.62 wt % Nickle, 3.36 wt % Manganese, 0.46 wt % Zinc, and a balance of Copper.

5. The cylinder block of claim 1 wherein the Siamese insert comprises one of an Aluminum alloy, a steel alloy, a bronze alloy, and a ceramic-metal material.

6. The cylinder block of claim 1 wherein the Siamese insert comprises a top surface that includes a head deck sealing surface.

7. The cylinder block of claim 1 wherein the shared cylinder bore wall comprises a first portion of the first cylinder bore liner, a second portion of the second cylinder bore liner, a third portion of the first cylinder bore wall, a fourth portion of the second cylinder bore wall, and the Siamese insert.

8. A cylinder block for use in an internal combustion engine, the cylinder block comprising:

a first and a second cylinder bores disposed adjacent to each other, the first and second cylinder bores each comprising a first cylinder bore wall and a second cylinder bore wall, respectively, and a shared cylinder bore wall;

a first cylinder bore liner and a second cylinder bore liner, and wherein the first cylinder bore liner is disposed on a first inner surface of the first cylinder bore wall and the second cylinder bore liner is disposed on a second inner surface of the second cylinder bore wall; and a Siamese insert comprising a top surface and a high temperature creep resistant alloy, wherein the Siamese insert is disposed in a top portion of the shared cylinder bore wall and the top surface includes a head deck sealing surface, and wherein the Siamese insert comprises a first and second bore liner pocket, and the first bore liner is partially disposed in the first bore liner pocket and the second bore liner is partially disposed in the second bore liner pocket.

9. The cylinder block of claim 8 wherein the Siamese insert comprises an Aluminum-Bronze alloy having between 8 to 10 wt. % Aluminum, Iron, Nickle, Manganese, Zinc, and Copper.

10. The cylinder block of claim 8 wherein the Siamese insert comprises an Aluminum-Bronze alloy having 9.62 wt % Aluminum, 3.93 wt % Iron, 0.62 wt % Nickle, 3.36 wt % Manganese, 0.46 wt % Zinc, and a balance of Copper.

11. The cylinder block of claim 8 wherein the Siamese insert comprises one of an Aluminum alloy, a steel alloy, a bronze alloy, and a ceramic-metal material.

12. The cylinder block of claim 8 wherein the shared cylinder bore wall comprises a first portion of the first cylinder bore liner, a second portion of the second cylinder bore liner, a third portion of the first cylinder bore wall, a fourth portion of the second cylinder bore wall, and the Siamese insert.

13. A method of manufacturing a cylinder block for an internal combustion engine, the method comprising:

forming a sand core package and mold comprising a cylinder bore liner for each cylinder of the engine;

fabricating a Siamese insert disposed between each cylinder bore liner, wherein the Siamese insert includes bore liner pockets, and each of the cylinder bore liners is partially disposed in one of the bore liner pockets;

casting the cylinder block by pouring a liquid metal alloy into the mold; and cleaning and machining the cylinder block after cooling.

14. The method of claim 13 wherein casting the cylinder block by pouring the liquid metal alloy into the mold further comprises pouring a liquid Aluminum alloy into the mold to cast-in-place the cylinder bore liners and Siamese inserts.

15. The method of claim 13 wherein fabricating the Siamese insert between each of the cylinder bore liners includes using a metal alloy additive technique.

16. The method of claim 13 wherein fabricating the Siamese insert between each of the cylinder bore liners includes using at least one of laser cladding, cold/kinetic spray, and thermal spray metal adding techniques.

17. The method of claim 13 wherein fabricating the Siamese insert includes brazing the Siamese insert between each of the cylinder bore liners and wherein the Siamese insert comprises a high temperature creep strength Aluminum-Bronze alloy.

* * * * *